US011490772B2

(12) United States Patent
Schwering et al.

(10) Patent No.: US 11,490,772 B2
(45) Date of Patent: Nov. 8, 2022

(54) VACUUM CLEANING UTENSIL HAVING ROTATING BRUSH

(71) Applicant: KONINKLIJKE PHILIPS N.V., Eindhoven (NL)

(72) Inventors: Coen Michiel Paul Schwering, Groningen (NL); Arjan Sander Vonk, De Wilp (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 386 days.

(21) Appl. No.: 16/621,446

(22) PCT Filed: Jun. 27, 2018

(86) PCT No.: PCT/EP2018/067329
§ 371 (c)(1),
(2) Date: Dec. 11, 2019

(87) PCT Pub. No.: WO2019/002414
PCT Pub. Date: Jan. 3, 2019

(65) Prior Publication Data

US 2020/0113397 A1 Apr. 16, 2020

(30) Foreign Application Priority Data

Jun. 30, 2017 (EP) ..... 17179193

(51) Int. Cl.
*A47L 9/04* (2006.01)
*A47L 9/00* (2006.01)

(52) U.S. Cl.
CPC ..... *A47L 9/0466* (2013.01); *A47L 9/009* (2013.01); *A47L 2201/00* (2013.01)

(58) Field of Classification Search
CPC ..... A47L 9/0466; A47L 9/009; A47L 2201/00
See application file for complete search history.

(56) References Cited

U.S. PATENT DOCUMENTS

| | | | |
|---|---|---|---|
| 9,414,729 | B2 | 8/2016 | Zydek |
| 2013/0047368 | A1 | 2/2013 | Tran |

FOREIGN PATENT DOCUMENTS

| | | | |
|---|---|---|---|
| CN | 101884512 | | 11/2010 |
| CN | 204133373 | U | 2/2015 |
| CN | 106491044 | A | 3/2017 |
| DE | 19507683 | | 9/1995 |
| DE | 102008014755 | | 9/2009 |
| DE | 102014100013 | | 7/2015 |
| EP | 2702917 | | 3/2014 |
| WO | 2013/157324 | | 10/2013 |
| WO | 2016/091320 | | 6/2016 |

OTHER PUBLICATIONS

International Search Report and Written Opinion dated Aug. 24, 2018 for International Application No. PCT/EP2018/067329 Filed Jun. 27, 2018.

*Primary Examiner* — Andrew A Horton
(74) *Attorney, Agent, or Firm* — Maschoff Brennan

(57) ABSTRACT

A vacuum cleaning utensil has a brush arranged for rotating about a substantially vertical axis. Further, the vacuum cleaning utensil has a guide for pushing the brush towards a surface to be cleaned during only a part of the rotation of the brush. During another part of the rotation, the brush is released from the surface to be cleaned.

8 Claims, 1 Drawing Sheet

VACUUM CLEANING UTENSIL HAVING ROTATING BRUSH

CROSS REFERENCE TO RELATED APPLICATIONS

This application is the U.S. National Phase application under 35 U.S.C. § 371 of International Application No. PCT/EP2018/067329 filed Jun. 27, 2019, published as WO 2019/002414 on Jan. 3, 2019, which claims the benefit of European Patent Application Number 17179193.2 filed Jun. 30, 2017. These applications are hereby incorporated by reference herein.

FIELD OF THE INVENTION

The invention relates to a vacuum cleaning utensil having a rotating brush rotating about a substantially vertical axis.

BACKGROUND OF THE INVENTION

Current side brushes that are used on e.g. robot vacuum cleaners, are used to guide the dirt to the suction mouth. This way the side brushes increase the reach of the robot vacuum cleaner. The side brushes are also very important for the removal of dirt around corners and edges.

DE 10 2015 101 587 discloses a robot vacuum cleaner having rotating brushes.

US 2013/0047368 discloses an auxiliary brush assembly for a vacuum cleaner.

WO 2013/157324 discloses a self-traveling cleaner that is provided with a housing capable of traveling by itself and having a suction opening in the bottom surface thereof; and a side brush provided in a rotatable manner at a side of the suction opening in the bottom surface of the housing. The side brush is provided with a brush base which rotates; and a brush bundle embedded in the brush base and having a front end coming into contact with a floor surface. The housing has a side protrusion provided on the bottom surface thereof at a position in front of the side brush, the side protrusion protruding downward so as to be capable of coming into contact with the brush bundle.

WO 2016/091320 discloses a side brush for a robotic cleaner. The side brush is rotatable about a rotation axis in a rotational direction and comprises a brush body and numerous linear bristles including a first bristle having a base end at the brush body and an opposite distal end. An imaginary line extends perpendicularly to the rotation axis. The first bristle extends in a bristle direction outwardly from the brush body. Seen in a top view the bristle direction extends at a first angle to the imaginary line with the distal end pointing rearwardly in relation to the rotational direction. Seen in a side view the bristle direction extends at a second acute angle to the rotation axis pointing away from the brush body. Further a robotic cleaner is disclosed herein.

SUMMARY OF THE INVENTION

It is, inter alia, an object of the invention to provide an improved vacuum cleaning utensil. The invention is defined by the independent claims. Advantageous embodiments are defined in the dependent claims.

One aspect of the invention provides a vacuum cleaning utensil having a brush arranged for rotating about a substantially vertical axis, wherein the vacuum cleaning utensil is provided with a guide for pushing the brush towards a surface to be cleaned during only a part of the rotation of the brush, while during another part of the rotation the brush is released from the surface. Advantageously, a vacuum cleaner is provided with a nozzle formed by such a vacuum cleaner utensil, and a robot vacuum cleaner is formed by such a vacuum cleaning utensil. The invention thus provides a system that defines the part of the rotation that the brush is in contact with the surface to be cleaned, and that causes the brush to be released from the surface in the desired place. This ensures that the dirt is collected by the brush and left in the desired place on the surface from where the dirt can be easily sucked up. The system preferably uses a curved track to guide the brush, preferably in combination with putting an axis of the brush assembly under an angle.

These and other aspects of the invention will be apparent from and elucidated with reference to the embodiments described hereinafter.

DESCRIPTION OF EMBODIMENTS

Figure 1:
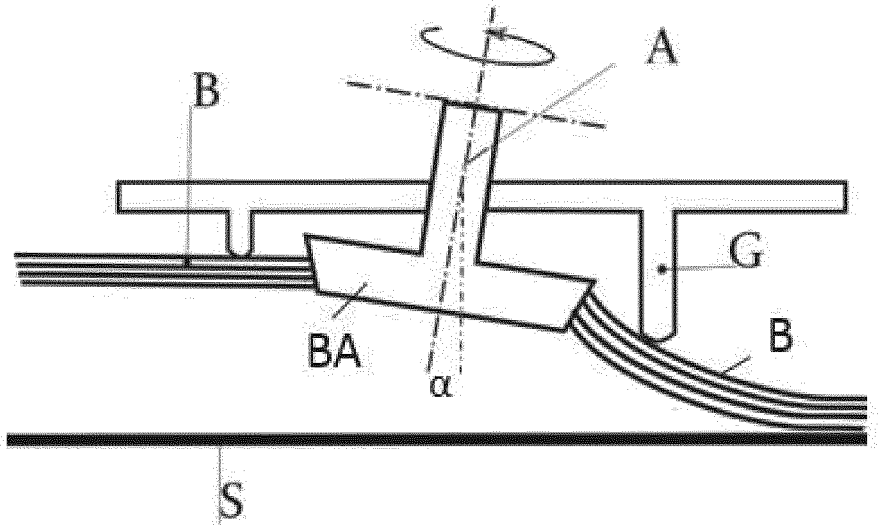
FIG. 1 shows an embodiment of a vacuum cleaner utensil in accordance with the invention.

FIG. 1 shows an embodiment of a vacuum cleaner utensil in accordance with the invention, which may be used in the context of a robot vacuum cleaner RVC having a (side) brush assembly BA having at least one rotating brush B, or in the context of a vacuum cleaner nozzle having such a (side) brush assembly BA. In this embodiment, the brush assembly BA is mounted substantially vertically, a brush axis A being at a non-zero angle $\alpha$ with respect to the vertical. In an embodiment, this angle $\alpha$ may be between 5 and degrees 30, and is preferably between 15 and 25 degrees, such as about 20 degrees. As a result, at a right-hand end, which would be at an outer edge of the vacuum cleaner, dirt is wiped from a surface S to be cleaned (e.g. a floor), while at a left-hand end, dirt is released from the brush B, where the dirt can be sucked up by a dirty air inlet (i.e. a suction mouth M) of a vacuum cleaner (nozzle).

An advantage of mounting the brush assembly BA at the angle $\alpha$ with respect to the vertical, is that by letting the brush B lose its connectivity with the surface S, it is possible to create a moment for the dirt to escape the rotational movement of the brush B. At this point the vacuum cleaner (nozzle) will be able to suck up the dirt. This results in a more efficient vacuum cleaner (nozzle).

In accordance with the invention, the vacuum cleaner utensil is provided with a guide G, e.g. a cam or rim at the bottom, which will help to better control the brush B. Without the guide G, the operation of the brush B is not optimized, as the brush B can be in contact with the surface S and free from the surface S at different places, so that the area where the brush B sweeps the surface S cannot be optimized. Just mounting the brush assembly BA at an angle with respect to the vertical does not yet give full control over at which part of the rotational movement of the brush the brush B is touching the surface S. Nor can it define accurately where the brush B is lifted or how 'quick' the brush is lifted from the surface S to be cleaned. The geometry of the guide G provided by the present invention provides that full control and thus does give an advantage in efficiency and effectiveness.

The guide G could bring the effect also without the brush axis A being mounted at a non-zero angle $\alpha$ with respect to the vertical (e.g. when the brush hairs B are mounted in such a way on the brush assembly BA that they only touch the surface S to be cleaned as a result of the guide G pushing them towards the surface S), but doing so would increase the deflection of the brush hairs B in the lower position, causing higher friction, wear and reduced lifetime. Besides that there is also an increased risk for brush deformation, so that part of the brush hairs B could remain deflected in the lower position causing the lifting effect to be reduced. So, in a preferred embodiment, the guide G is present in combination with the brush axis A being at a non-zero angle $\alpha$ with respect to the vertical.

Figure 2:
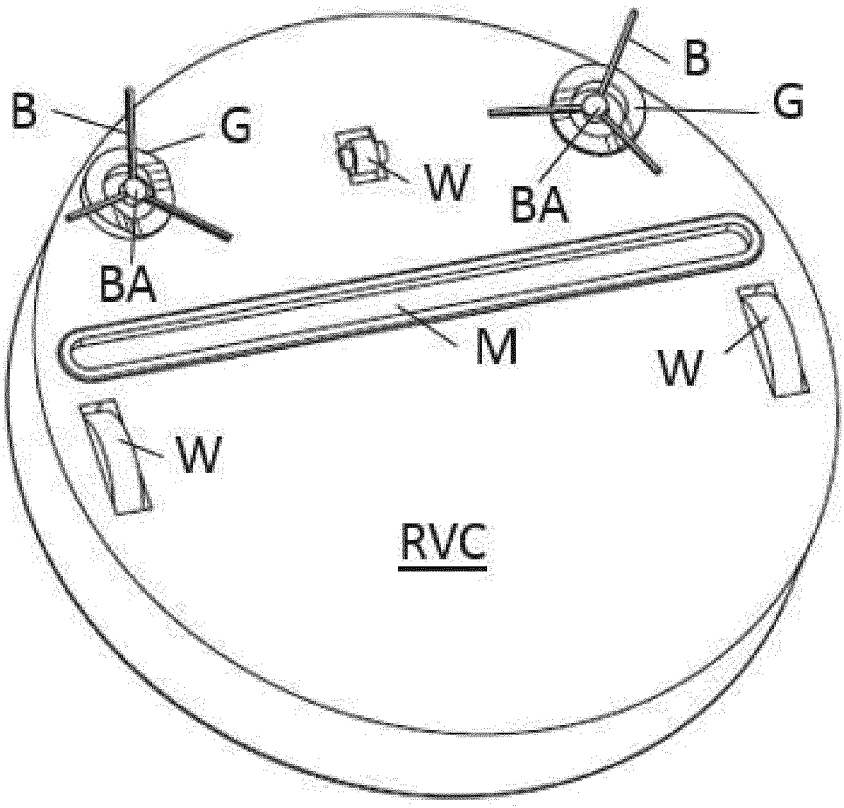
FIG. 2 shows a bottom view of a robot vacuum cleaner in accordance with the present invention.

FIG. 2 shows a bottom view of a robot vacuum cleaner RVC in accordance with the present invention. The robot vacuum cleaner RVC has three wheels W, two brush assemblies BA each having three brushes B, and a suction mouth M that functions as an inlet for dirty air. In accordance with this embodiment of the invention, at each brush assembly BA the bottom of the robot vacuum cleaner RVC is provided with a round guide G that pushes the brush B downwards towards the surface to be cleaned S at an outer edge of the robot vacuum cleaner RVC. In an embodiment, at that part of the guide G (i.e. at the outer edge of the robot vacuum cleaner RVC), its height is between 5 and 15 mm, preferably not exceeding 10 mm. The height of the guide G is lower at a side of the guide G directed towards the suction mouth M, so that there the brush B is released from the surface to be cleaned S so that dirt can leave the brush B and be sucked up at the suction mouth M.

Embodiments of the invention thus provide a vacuum cleaning utensil having a brush B arranged for rotating about a substantially vertical axis A, and a guide G for pushing the brush B towards a surface S to be cleaned during a part of the rotation of the brush B. Preferably, the guide G has a height that varies along a circumference of the guide G so as to define the part of the rotation where the brush B is pushed towards the surface S, preferably at a part of the rotation where the brush B is directed away from a suction mouth M. A height of the guide G, or at least a part of the guide G that pushes the brush B most towards the surface S, may be between 5 and 15 mm, preferably not exceeding 10 mm. Preferably, the brush B is mounted at an angle $\alpha$ with respect to the vertical, which angle $\alpha$ may be between 5 and 30 degrees, and is preferably between 15 and 25 degrees. A vacuum cleaner is advantageously provided with a nozzle formed by such a vacuum cleaner utensil. A robot vacuum cleaner RVC is advantageously formed by such a vacuum cleaning utensil.

It should be noted that the above-mentioned embodiments illustrate rather than limit the invention, and that those skilled in the art will be able to design many alternative embodiments without departing from the scope of the appended claims. For example, instead of a round guide G having a varying height as described above in relation to FIG. 2, it is possible to have a guide G that is only present at the part of the rotation where it is desired to push the brush B towards the surface to be cleaned S. The brush assembly BA may have one or more discrete brushes B as shown in FIG. 2, or a single brush B around its circumference. In the claims, any reference signs placed between parentheses shall not be construed as limiting the claim. The word "comprising" or "having" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A vacuum cleaning utensil having a brush arranged for rotating about a substantially vertical axis, wherein the vacuum cleaning utensil is provided with a guide for pushing the brush towards a surface to be cleaned during only a part of the rotation of the brush, the brush being arranged for being released from the surface during another part of the rotation.

2. The vacuum cleaning utensil as claimed in claim 1, wherein the guide has a height that varies along a circumference of the guide so as to define the part of the rotation where the brush is pushed towards the surface.

3. The vacuum cleaning utensil as claimed in claim 1, wherein the guide is arranged for pushing the brush towards the surface where the brush is facing away from a suction mouth, the brush being arranged for being released from the surface where the brush is facing the suction mouth.

4. The vacuum cleaning utensil as claimed in claim 1, wherein a height of the guide, or at least a part of the guide that pushes the brush most towards the surface, is between 5 and 15 mm, preferably not exceeding 10 mm.

5. The vacuum cleaning utensil as claimed in claim 1, wherein the brush is mounted at an angle with respect to the vertical axis.

6. The vacuum cleaning utensil as claimed in claim 5, wherein the angle is between 5 and 30 degrees, and preferably between 15 and 25 degrees.

7. A vacuum cleaner provided with a nozzle formed by the vacuum cleaner utensil as claimed in claim 1.

8. A robot vacuum cleaner formed by the vacuum cleaning utensil as claimed in claim 1.

* * * * *